US009988902B2

(12) United States Patent
Proett et al.

(10) Patent No.: US 9,988,902 B2
(45) Date of Patent: Jun. 5, 2018

(54) DETERMINING THE QUALITY OF DATA GATHERED IN A WELLBORE IN A SUBTERRANEAN FORMATION

(71) Applicants: Mark Proett, Missouri City, TX (US); Sami Eyuboglu, Houston, TX (US)

(72) Inventors: Mark Proett, Missouri City, TX (US); Sami Eyuboglu, Houston, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 605 days.

(21) Appl. No.: 14/516,854

(22) Filed: Oct. 17, 2014

(65) Prior Publication Data

US 2015/0112599 A1 Apr. 23, 2015

Related U.S. Application Data

(60) Provisional application No. 61/892,985, filed on Oct. 18, 2013.

(51) Int. Cl.
*E21B 49/10* (2006.01)

(52) U.S. Cl.
CPC ..... *E21B 49/10* (2013.01)

(58) Field of Classification Search
CPC .... E21B 49/084; E21B 49/088; E21B 49/087; E21B 49/08; E21B 49/10; E21B 49/00; E21B 2049/085
See application file for complete search history.

(56) References Cited

U.S. PATENT DOCUMENTS

| | | | | |
|---|---|---|---|---|
| 4,884,439 | A | 12/1989 | Baird | |
| 6,301,959 | B1 | 10/2001 | Hrametz et al. | |
| 8,439,110 | B2 | 5/2013 | Corre et al. | |
| 2007/0198192 | A1* | 8/2007 | Hsu | E21B 47/12 702/6 |
| 2008/0156088 | A1* | 7/2008 | Hsu | E21B 49/10 73/152.23 |

OTHER PUBLICATIONS

Proett et al., Objectively Quantifying Wireline and LWD Pressure Test Quality, SPWLA 55th Annual Logging Symposium, 2014.

(Continued)

*Primary Examiner* — Toan Le
(74) *Attorney, Agent, or Firm* — McDermott Will & Emery LLP

(57) ABSTRACT

Methods for determining the quality of data gathered in a wellbore in a subterranean formation including (a) collecting a formation fluid sample in the wellbore in the subterranean formation using a formation tester for receiving the formation fluid, wherein the formation tester is lowered to at least one depth in the wellbore in the subterranean formation by a conveyor; (b) acquiring a wellbore measurement ("WM") from the least one depth with the formation tester; (c) determining from the WM a measured quality value ("MQV"); (d) assigning a threshold value ("TV") to the MQV; (e) assigning a range value ("RV") to the MQV, based on geometric scaling of the TV, the RV defining the limits of the MQV above and below the TV; and (f) calculating a score value ("SV") based on the MQV, the TV, and the RV, wherein the SV is a number between 0 and 2*TV, and wherein the quality of the WM increases as the SV increases.

25 Claims, 6 Drawing Sheets

(56) References Cited

OTHER PUBLICATIONS

Proett et al., Formation Testing in the Dynamic Drilling Environment, SPWLA 45th Annual Logging Symposium, 2004.
Proett et al., Supercharge Pressure Compensation Using a New Wireline Testing Method and Newly Developed Early Time Spherical Flow Model, 1996 SPE Annual Technical Conference and Exhibition held in Denver, Colorado, SPE 36524.

* cited by examiner

| QUALITY DATA | | USER INPUT FOR MQV | | | | QUALITY ATTRIBUTES BASED ON SV | | | | | | | | | |
|---|---|---|---|---|---|---|---|---|---|---|---|---|---|---|---|
| MQV | UNITS | TV | | RV (> 1) | RV (0-1) | HIGH QUALITY | | GOOD QUALITY | | VALID QUALITY | | FAIR QUALITY | | LOW QUALITY | |
| STABILITY PRESSURE | PSIA/MIN | ≤ | 0.5 | 10 | 0.5 | ≤ | 0.158 | ≤ | 0.158 | ≤ | 0.5 | ≤ | 1.581 | ≤ | 5 |
| STABILITY PRESSURE STD. DEV | PSIA | ≤ | 0.1 | 100 | 1 | ≤ | 0.001 | ≤ | 0.01 | ≤ | 0.1 | ≤ | 1 | ≤ | 10 |
| STABILITY TEMPERATURE | °F/MIN | ≤ | 0.01 | 5 | 0.5 | ≤ | 0.002 | ≤ | 0.004 | ≤ | 0.01 | ≤ | 0.022 | ≤ | 0.05 |
| DRAWDOWN MOBILITY | MD/CP | ≥ | 1 | 100 | 0.8 | ≥ | 100 | ≥ | 10 | ≥ | 1 | ≥ | 0.1 | ≥ | 0.01 |
| RADIUS OF INVESTIGATION | FT | ≥ | 10 | 10 | 0.3 | ≥ | 100 | ≥ | 31.62 | ≥ | 10 | ≥ | 3.16 | ≥ | 1 |
| SUPERCHARGE | PSI | ≤ | 1 | 4 | 0.7 | ≤ | 0.25 | ≤ | 0.5 | ≤ | 1 | ≤ | 2 | ≤ | 4 |
| TEST QUALITY | 4-0 SCORE | - - | 2 | - - | - - | - - | 4 | - - | 3 | - - | 2 | - - | 1 | - - | 0 |

FIG. 5

| DESCRIPTOR QUALITY ATTRIBUTE | | USER INPUT FOR MQV FOR DESCRIPTOR QUALITY ATTRIBUTE | |
|---|---|---|---|
| MQV | UNITS | MQV | |
| MUD SET | PSIA | < | 20 |
| TIGHT | MD/CP | < | 0.05 |
| LOW PERMEABILITY | MD/CP | < | 0.5 |
| SUPERCHARGE | PSIA | > | 2.5 |
| SUPERCHARGED + LOW PERMEABILITY | MD/CP | < | 0.5 |
| | PSIA | > | 2.5 |

FIG. 6

DETERMINING THE QUALITY OF DATA GATHERED IN A WELLBORE IN A SUBTERRANEAN FORMATION

BACKGROUND

The present disclosure is related to determining the quality of data gathered in a wellbore in a subterranean formation and, more particularly, to determining the quality of data gathered during wireline and logging-while-drilling testing.

During the drilling and completion of oil and gas wells, the subterranean formation of interest may be evaluated for its production capabilities. For example, after a wellbore or sections of a wellbore have been drilled, zones of interest at varying depths may be tested or sampled to determine various formation properties such as permeability, fluid type, fluid quality, formation temperature, formation pressure, bubble point, formation gradient, and the like. These tests may be completed during wireline logging ("WL") and logging-while-drilling ("LWD"), collectively referred to herein as "formation testing," by employing a formation tester ("FT"). As used herein, the term "formation tester," and all grammatical variants thereof (e.g., "formation testing tool"), refer to a tool capable of performing wellbore testing at a downhole location, and may include drawing a fluid sample from the formation face forming the wellbore.

Formation testing typically involves a complex set of procedures to draw formation fluids into a formation tester and properly analyze the fluid sample. For example, a probe must be properly extended from the formation tester to sealingly engage the formation. Internal pistons and pumps must then be actuated to allow a proper amount of fluid to flow from the formation and into the formation tester. Despite the complexity, formation testing may be invaluable in determining whether further operations or commercial exploitation of a drilled or partially drilled formation is viable. Such testing may further provide information on how to optimize production from viable formations. Accordingly, the acquisition of accurate data from a wellbore is critical to making an informed decision about the practicability of moving forward with operations in a particular formation. If the test data are incorrect, significant financial, work time, and economic costs may be realized.

BRIEF DESCRIPTION OF THE DRAWINGS

The following figures are included to illustrate certain aspects of the embodiments, and should not be viewed as exclusive embodiments. The subject matter disclosed is capable of considerable modifications, alterations, combinations, and equivalents in form and function, as will occur to those skilled in the art and having the benefit of this disclosure.

FIG. 5 is a spreadsheet medium comprising a set of MQV, TV, RV, and WF values graphically displayed according to one or more embodiments of the present disclosure.

FIG. 6 is a spreadsheet medium comprising descriptor quality attributes graphically displayed according to one or more embodiments of the present disclosure.

DETAILED DESCRIPTION

Figure 1:
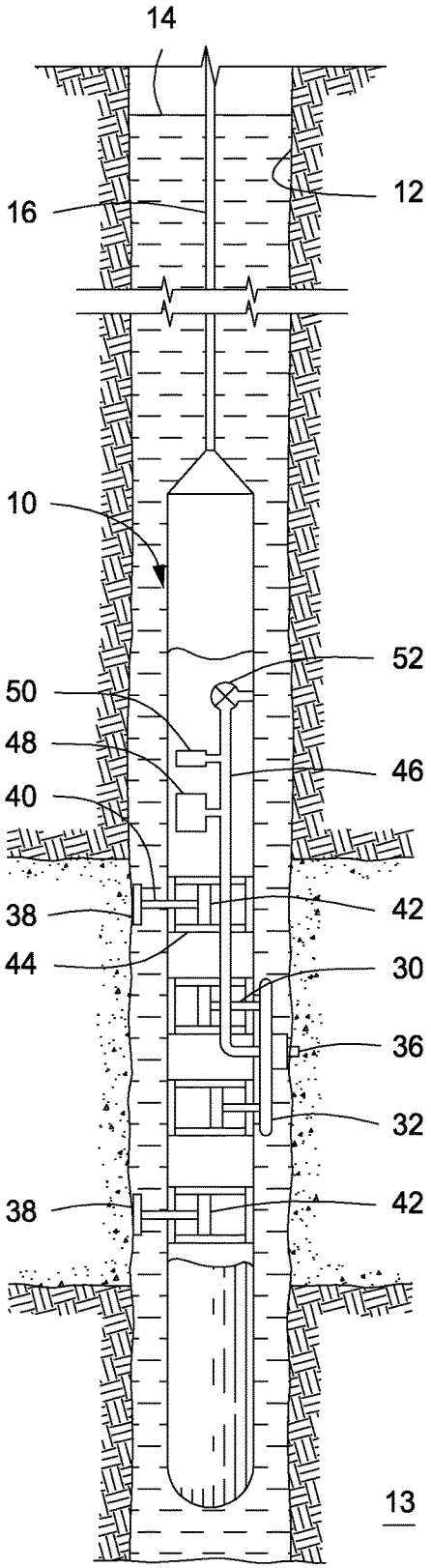
FIG. 1 is a diagram of a formation tester suspended in a wellbore for conducting formation testing according to one or more embodiments of the present disclosure.

The present disclosure is related to determining the quality of data gathered in a wellbore in a subterranean formation and, more particularly, to determining the quality of data gathered during wireline and logging-while-drilling testing.

One or more illustrative embodiments disclosed herein are presented below. Not all features of an actual implementation are described or shown in this application for the sake of clarity. It is understood that in the development of an actual embodiment incorporating the embodiments disclosed herein, numerous implementation-specific decisions must be made to achieve the developer's goals, such as compliance with system-related, lithology-related, business-related, government-related, and other constraints, which vary by implementation and from time to time. While a developer's efforts might be complex and time-consuming, such efforts would be, nevertheless, a routine undertaking with the benefit of this disclosure.

It should be noted that when "about" is provided herein at the beginning of a numerical list, the term modifies each number of the numerical list. In some numerical listings of ranges, some lower limits listed may be greater than some upper limits listed. One skilled in the art will recognize that the selected subset will require the selection of an upper limit in excess of the selected lower limit. Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the exemplary embodiments described herein. At the very least, and not as an attempt to limit the application of the doctrine of equivalents to the scope of the claim, each numerical parameter should at least be construed in light of the number of reported significant digits and by applying ordinary rounding techniques.

While compositions and methods are described herein in terms of "comprising" various components or steps, the compositions and methods can also "consist essentially of" or "consist of" the various components and steps. When "comprising" is used in a claim, it is open-ended.

One method of determining the test quality of formation testing measurements is to measure and evaluate certain pretest and test data, including drawdown mobility (milli-Darcy/centipoise, or "mD/cP") and buildup stability (pounds per square inch/minute, or "psi/min"). "Pretest," as used herein, refers to a preliminary test (e.g., a pressure test) that is performed after positioning a formation tester and before collecting fluid samples for analysis. Pretests are frequently performed when only the pressure and mobility information is required and a sample is not taken. As used herein, the term "drawdown mobility" (or "formation mobility") refers to the quality of a reservoir rock and is proportional to the drawdown flow rate versus the magnitude of a pressure drop recorded during fluid draw from a subterranean formation (e.g., a reservoir). The formation mobility is equivalent to the ratio of effective permeability to phase viscosity (i.e., water, oil, or gas). As used herein, the term "buildup stability" (encompassing "buildup pressure stability" and "buildup temperature stability") refers to the pressure and temperature of a formation after fluid drawn therefrom (e.g., in its shut-in state). During the buildup (or shut-in), the pressure increases and the rate of change or stability depends primarily on the formations mobility. Temperature can also vary but depends on ambient wellbore conditions that can be heating or cooling a formation tester's pressure gauge. While pressure gauges are calibrated over a wide range of temperatures and pressures, these calibrations are at static conditions and dynamic variations can affect the pressure gauge accuracy.

Typically, an analyst evaluates the drawdown mobility and buildup stability measurements taken by the formation tester and assigns a "valid" or "invalid" quality attribute thereto. As used herein, the terms "attribute" or "quality attribute" refer to a descriptor assigned to a particular measurement based on the quality of the test used to acquire the measurement. Such attributes may be based on user input relating to experience with particular formation types, operations, and the like. However, the analyst's "valid" or "invalid" attribute remains subjective and, additionally, the magnitude of the quality of the measurement is unknown. Moreover, the quality of the formation tester's testing is typically limited to only two measurements, drawdown mobility and buildup stability.

The present disclosure provides methods for objectively quantifying formation test quality in a systematic way. The instant embodiments employ a scoring methodology that can be used to not only objectively determine the validity of a wellbore measurement, but to stratify it based on quality magnitude (e.g., high quality, good quality, valid, fair quality, low quality). The embodiments herein also allow significant user input in assigning threshold values that are specific to a particular situation (e.g., particular formation, particular operation, particular formation fluid, and the like), allowing users to assign stratification gradients of any size to the quality measurements (i.e., to further assign quality attribute values beyond, e.g., high, good, valid, fair, and low). These user inputs may be achieved without affecting the objective nature of the quality determinations described herein.

The present disclosure also broadens the type of quality parameters that may be evaluated to better estimate the quality of a particular wellbore measurement, and takes into account a wider array of information. For example, the standard deviation of buildup pressure stability may be taken into account due to noise caused by mud flow (which may be present during testing in the wellbore) that may affect the quality of the test. The estimated radius of investigation may be considered as a quality test parameter. The estimated supercharge potential may also be used to evaluate test data, as supercharging is a concern for pressure measurements when the pressure measured is influenced by mud filtrate invasion that has elevated the pressure at or near the wellbore. As another example, evaluation of a buildup stability value that is greater or less than expected may imply some irregularity in the testing.

Referring now to FIG. 1, a portion of a wellbore 12 is shown in a subterranean formation 13. The wellbore 12 is shown to be open hole, however, the wellbore 12 may be partly or wholly cased with a casing string, which may or may not be cemented, in such a way that allows the formation tester 10 to contact the formation 13, without departing from the scope of the present disclosure. The wellbore 12 may, as shown, be filled with a fluid 14, such as a drilling fluid (i.e., drilling mud). Formation tester 10 is suspended in the wellbore 12 by means of a conveyor 16. The conveyer 16 may lead to a rig at the surface (not shown). The conveyor 16 may be an armored cable, such as a well logging cable, having electrical conductors enclosed in the cable and connected to a power source at the surface for receiving and/or transmitting signals. The conveyer may also be a drill string consisting of connected pipe lengths deployed on a drilling rig or a continuous length of tubing deployed by a coiled tubing unit. These pipe conveyed systems may use wire, acoustic pulses or electromagnetic signals to convey data to and from the formation tester 10. The length of the conveyor 16 may depend on the depths the formation tester 10 is expected to traverse to perform formation testing and may be, in some instances, tens of thousands of feet.

The body of the formation tester 10 is depicted as elongate and cylindrical in shape, any shape that may be extended into a wellbore may be suitable, without departing from the scope of the present disclosure. The formation tester 10 has a probe 30 that laterally extends therefrom. The extended probe may be surrounded by a sealing pad 32, as shown, intended to form a seal with the subterranean formation 13 once the probe 30 is extended and contacted therewith. The sealing pad 32 may be formed into a loop to encircle the probe 30. The sealing pad 32 may be composed of an elastomeric material or other elastic material capable of forming a seal with the subterranean formation 13. A more conventional expandable element may also be used to effect a seal with the formation similar to that used in drill stem testing, without departing from the scope of the present disclosure. There may be a single expandable element with probe openings on its surface, two expandable elements isolating a sealed interval of the well bore for testing, or more.

Formation fluid from the subterranean formation 13 is tested by extending the sealing pad 32 against the wellbore 12 to contact the formation 13 and extending a probe snorkel tube 36 from the probe 30. The seal formed by the sealing pad 32 and the formation 13 is intended to prevent invasion of open hole pressure or drilling fluids into the vicinity of the extended probe snorkel tube 36. The probe snorkel tube 36 is connected to a flow line 46. Formation testing typically occurs after the sealing pad 32 is positioned against the wellbore 12 of the formation 13 and clamping mechanisms 38 are extended laterally from the formation tester 10 and against a portion of the wellbore 12 of the formation 13 to hold the formation tester 10 in place at a depth in the wellbore 12. The clamping mechanisms 38 may operate by actuating a piston 42 and a piston rod 40 in a hydraulic cylinder 44. A similar mechanism may laterally extend the probe 30 to contact the sealing pad 32 against the formation 13. However, the clamping mechanisms 38 and probe 30 may also operate to hold the formation tester 10 in the wellbore 12 or form a seal with the formation 13, respectively, by any other mechanism, without departing from the scope of the present disclosure.

As depicted, the clamping mechanisms 38 are disposed on the formation tester 10 opposite the probe 30, they may be located at any position on the formation tester 10 so long as they are able to hold the formation tester 10 in place during formation testing, without departing from the scope of the present disclosure. Two clamping mechanisms 38 are shown, although one or more than two may also be employed. Furthermore, a formation tester may also have fixed clamping extensions or features that do not extend from the body of the tester but are clamping points when the probe is extended and push the tool against the wellbore 12.

During formation testing, the formation tester 10 is first positioned such that the sealing pad 32 and the one or more clamping mechanisms 38 are in contact with the formation 13. The probe snorkel tube 36 is connected to a flow line 46, and the flow line 46 is connected to a pretest chamber 48, a gauge 50, and an equalization value 52. In some embodiments, the pretest chamber 48 may be about 10 to about 100 $cm^3$. One or more additional components may additionally be connected to the flow line 46, without departing from the scope of the present disclosure. For example, additional pretest chambers 48 may be located in fluid communication with the flow line 46, as well as one or more sample chambers for collecting formation fluid. The gauge 50 measures pressure and temperature.

Once the formation tester 10 is positioned, a pretest may then be taken. As described above, the pretest is a quick, preliminary test that is performed after positioning the formation tester 10 to determine the quality of the test point before deciding to fill one or more sample chambers (not shown). Pretests may also be used to measure formation pressure and near wellbore mobility, as well as other specialized tests, such as interval pressure-transient tests.

When the pretest operation begins, the gauge 50 begins measurement operations, for example, by reading the hydrostatic wellbore pressure. The gauge 50 typically includes a temperature sensor temperature that is also recording temperature during a pretest sequence and is used for gauge calibration corrections, as well. The equalization valve 52 is normally open when the gauge 50 recording starts so that the pressure in the flow line 46 is equalized with the hydrostatic pressure of the fluid in the wellbore 12 (also referred to as "wellbore hydrostatic pressure" or "wellbore mud hydrostatic pressure"). The equalization valve 52 is closed either before or after extending the probe 30 which isolates the flow line 46 from the wellbore 12 when the probe 30 makes sealing contact. A small piston (not shown) in the formation tester 10 then moves at a constant rate to create a drawdown flow rate ($q_{dd}$), which in some instances may last between 5 to 20 seconds, depending on the volume of the pretest and flow rate. Other methods may also be used to move fluid into the formation tester 10 such as a pump or by opening a valve to a chamber, such that the flow rate and volume are controlled, without departing from the scope of the present disclosure.

During the pretest drawdown a small amount of fluid is withdrawn or produced from the formation 13 through the probe snorkel tube 36 and into the flow line 46. As the fluid is drawn into the formation tester 10, the gauge 50 continues measurement operations, recording a decrease in pressure as the formation fluid is produced into the formation tester 10 flow line 46. After the drawdown, the pressure in the flow line 46 increases when the production of fluid from the formation 13 has stopped and the pressure buildup is monitored. After the drawdown buildup sequence is completed, the flow line 46 is again exposed to hydrostatic pressure by opening the equalization valve 52 and the probe, and the probe 30 and clamping mechanisms 38 are retracted (e.g., toward or into the formation tester 10 body).

Figure 2:
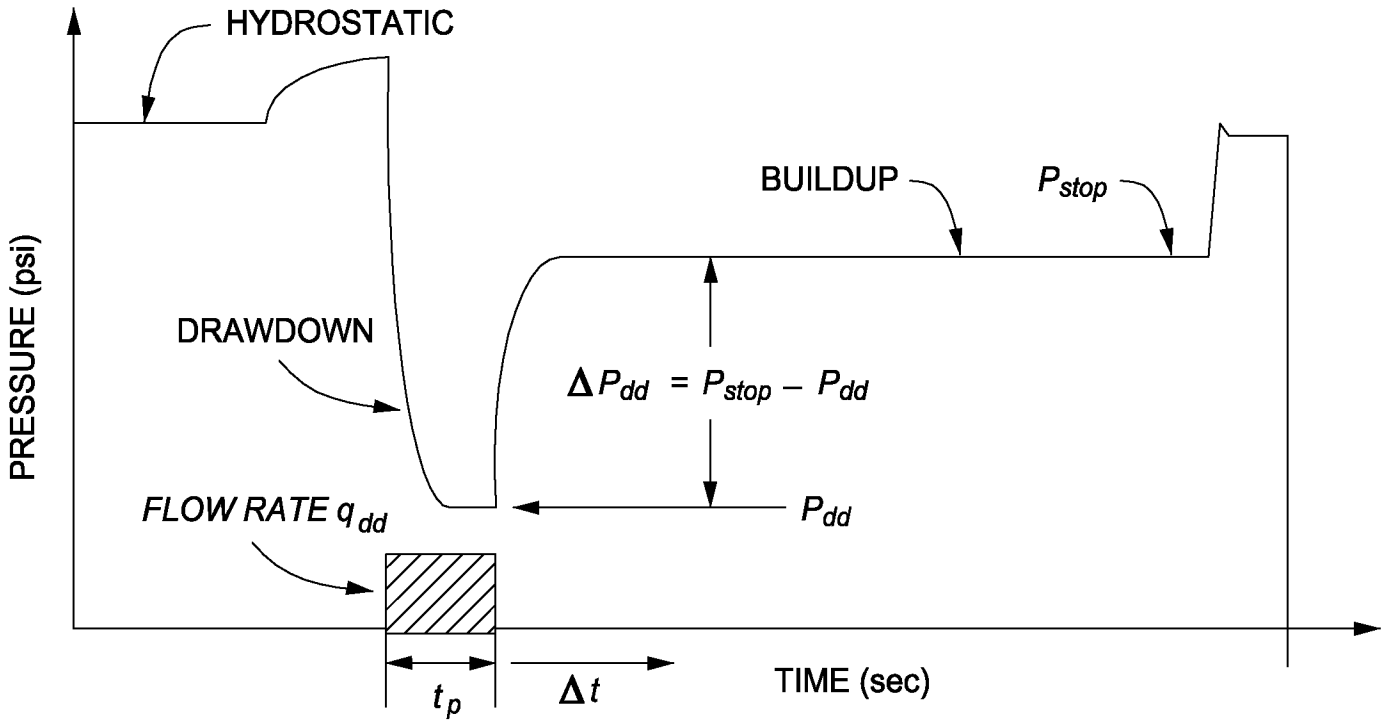
FIG. 2 is a pressure time plot for a drawdown-buildup sequence according to one or more embodiments of the present disclosure.

Referring now to FIG. 2, depicted is a pressure time plot for a typical pretest showing one drawdown and one buildup. In practice, the pretests may have at least two or more drawdown-buildup sequences, as previously described. Initially, the pressure gauge 50 reads the hydrostatic pressure. During the positioning of the formation tester 10 in the wellbore 12, the pressure often increases or decreases depending on the type of formation tester 10 in use, and may also be related to the sequencing of the probe extension and closing of the equalization valve. The pressure is shown as increasing slightly in FIG. 2 during the setting process. As the formation fluid is drawn into the flow line 46 at a flow rate ($q_{dd}$) from the probe snorkel tube 36, the pressure drops below hydrostatic pressure, termed the "drawdown." The bottom most pressure reached during the drawdown is the drawdown pressure ($P_{dd}$). When the pretest piston stops moving and fluid is no longer drawn into the fluid line 46, the pressure increases and results in a pressure "buildup" transient. The pressure is allowed to buildup until it is stable ($P_{stop}$). The flow line 46 is then returned to hydrostatic pressure when the equalization valve 52 (FIG. 1) is opened. The drawdown differential ($\Delta_{dd}$) is equivalent to Equation I:

$$\Delta P_{dd} = P_{stop} - P_{dd} \qquad \text{Equation I}$$

The equations presented herein represent only a subset of the formulas that may be used to calculate and/or estimate the quality values described herein. The equations herein are examples only. Other equations may be used, without departing from the scope of the present disclosure, and without affecting the applicability of the scoring methodologies for determining quality measurements provided herein.

Using the drawdown the buildup measurements made during pretesting, several estimates or calculations are made to evaluate the viability of the formation. Once such estimate is spherical drawdown mobility (mD/cP) (or simply "drawdown mobility"). Drawdown mobility is calculated assuming pseudo-steady state hemispherical flow. Pseudo-steady state hemispherical flow is assumed when the drawdown pressure has nearly stabilized and the pretest piston is moving at a constant rate. Then, assuming the final pressure of the buildup is formation pressure ($P_{stop}$), the drawdown differential is equivalent to Equation I, and the drawdown mobility may be determined according to Equation II:

$$M_{sdd} = \frac{k_s}{\mu} = \left(\frac{14{,}696}{2\pi}\right)\left(\frac{\tau_p}{r_p}\frac{q_{dd}}{\Delta P_{dd}}\right), \qquad \text{Equation II}$$

where, $M_{sdd}$, is the spherical drawdown mobility (mD/cP), $k_s$, is the formation spherical permeability (mD), $\mu$, is viscosity (cP), the number 14,696 is a conversion factor for the units used, $\tau_p$ is the probe flow coefficient (dimensionless and from 1.5 to 1.0), $r_p$, is the prome radius (cm), $q_{dd}$, is the drawdown flow rate ($cm^3$/sec), and $\Delta P_{dd}$, is the drawdown differential pressure (psi). Frequently the conversion factor, $2\pi$, $\tau_p$ and $r_p$ are combined into a single probe flow coefficient $C_{pf}$, as shown in Equation III below. The probe flow coefficient $C_{pf}$ depends on at least the size of the probe, geometry of the probe (e.g., circular, elongated, multiple openings, and the like) and the borehole size. The probe flow coefficient $C_{pf}$ has the units of mD/cP-psi-sec/$cm^3$.

$$M_{sdd} = \frac{k_s}{\mu} = C_{pf}\frac{q_{dd}}{\Delta P_{dd}} \qquad \text{Equation III}$$

When a formation tester 10 (FIG. 1) is initially positioned, several drawdown-buildup tests are typically performed and the last drawdown-buildup pretest sequence is generally used for determining drawdown mobility. The last pretest is generally used because the first pretest's primary purpose is to remove the mudcake and decrease the pressure below the hydrostatic and formation pressure. By performing additional drawdown-buildup sequences after the first sequence, the starting pressure is closer to the formation pressure which is the initial condition assumed by the pseudo-steady state hemispherical model, as shown in Equation II. The more drawdown-buildup pretests that are performed will further reduce the wellbore effects attributable to invasion. Regardless, the last drawdown-buildup pretest is generally well suited for use in determining drawdown mobility.

In some embodiments herein, the methods described in the present disclosure are applied to drawdown mobilities greater than about 0.1 mD/cP, and in some insurances in the range of a lower limit of about 0.1 mD/cP, 1 mD/cP, 50 mD/cP, 100 mD/cP, 150 mD/cP, 200 mD/cP, 250 mD/cP, 300 mD/cP, 350 mD/cP, 400 mD/cP, 450 mD/cP, and 500 mD/cP to an upper limit of about 1000 mD/cP, 950 mD/cP, 900 mD/cP, 850 mD/cP, 800 mD/cP, 750 mD/cP, 700 mD/cP, 650 mD/cP, 600 mD/cP, 550 mD/cP, and 500 mD/cP, encompassing any value and subset therebetween.

When drawdown mobility is below about 1 mD/cP, the pseudo-steady steady state assumptions may be optimistic because the drawdown pressure may not have fully stabilized. In such circumstances, the methods of the present disclosure provide for an additional layer of quality guidance, where such drawdown mobilities are assigned an attribute.

If the drawdown mobility falls below about 1 mD/cP, or another value selected by an analyst, for example, a descriptive quality attribute is provided for the particular test, indicating that the formation is either "low permeability" (or "low perm") or "tight." The scoring methodology described herein, and below, provides an objective means to assign such attributes to a given quality parameter (e.g., a drawdown mobility).

Pressure stability and temperature stability may be gleaned from the buildup pressure in a drawdown-buildup pretest, which may be used as a quality measurement to determine the viability of the test point using a formation tester 10 (FIG. 1). The standard deviation of the pressure stability and temperature stability may also be determined, which may also be used as a quality measurement. The pressure stability and the temperature stability are determined from the slope of a linear least-squares regression ("LSR") using data from the buildup in a drawdown-buildup sequence. In some embodiments, the LSR is determined from about the last 60 seconds of the buildup, however a greater or lesser amount of time may be used to perform LSR to determine pressure stability and/or temperature stability. Ideally, the temperature stability would be zero because any transient in the gauge 50 (FIG. 1) measuring temperature may be attributed to a pressure error. Typically, temperature stability is generally stable and may be, in some instances, less than about ±0.010° F./min (about ±0.056° F./sec) and has very little effect on the pressure stability or buildup pressure measurements. However, higher temperature instabilities may occur, particularly when the temperature of the formation tester 10 (FIG. 1) is lower or higher that the wellbore 12 (FIG. 1). This may happen when the formation tester 10 (FIG. 1) is lowered or raised to a depth point quickly and not allowed to equilibrate with the wellbore 12 (FIG. 1) temperature. Higher temperature instabilities may cause errors in the pressure readings because the pressure reading is calibrated based on a stable temperature reading.

Figure 3:
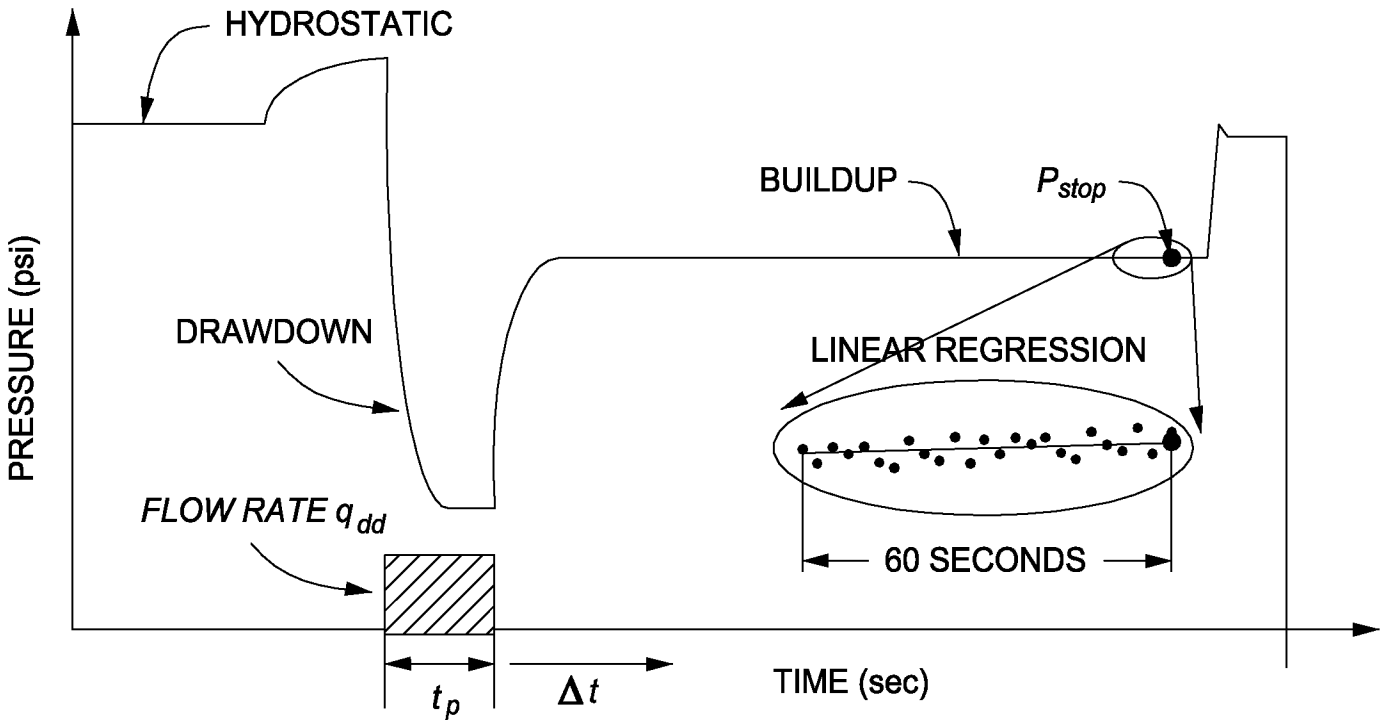
FIG. 3 is a pressure time plot for a drawdown-buildup sequence with a linear least-squares regression line fitted to the last 60 seconds of the buildup pressure data to determine pressure stability.

FIG. 3 illustrates an example of a portion of the drawdown-buildup sequence that may be used to determine pressure stability (e.g., fitting a LSR to the last 60 seconds of the buildup pressure data). Ideally, the LSR line for pressure stability would depend on drawdown mobility. However, in practice, such a dependency is not always the case due to such factors as near wellbore invasion of mud filtrate (e.g., from drilling mud) and during the time the mudcake is being formed in the wellbore. If the mudcake formed instantaneously with a perfect hydraulic seal, isolating the wellbore from the formation, then the drawdown mobility would have the most significant influence on pressure stability. However, even with a very small (e.g., fractional) leakage of the mud filtrate through the mudcake, the pressure stability can be affected, and to a much lesser extent the temperature stability. For very low permeability formations 13 (FIG. 1), supercharging may be another influence on the pressure stability and/or temperature, as discussed in greater detail below as another quality parameter for use in the methods described herein.

The LSR line may be determined using a standard linear regression model, such as that shown in Equations IV through VI:

$$y=a+bx \qquad \text{Equation IV,}$$

where b, is the slope for the pressure stability or temperature stability (determined by Equation V below), a, is the pressure or temperature intercept (shown in Equation V), y, is the dependent variable (pressure or temperature, and x, is the independent variable (e.g., time in minutes):

$$a=\bar{y}-b\bar{x} \qquad \text{Equation V,}$$

$$b=\frac{\sum x_i y_i-\frac{1}{n}\sum x_i\sum y_i}{\sum x_i^2-\frac{1}{n}(\sum x_i)^2}, \qquad \text{Equation VI}$$

where, $y_i$, is the dependent variable of the pressure or temperature data, $\bar{y}$, is the mean of $y_i$, $x_i$, is the independent variable of the time data, $\bar{x}$, is the mean of $x_i$, and n is the number of pressure or temperature measurements taken. The paired data points $(x_i,y_i)$ are selected from the final data point $x_n,y_n$ (see FIG. 3, $P_{stop}$ or $T_{stop}$) and working backward in time for the paired data points i=1 to n typically comprising 60 seconds of data.

The LSR equations may also be used to estimate the final pressure and temperature at the end of the buildup. The use of the LSR liner equations to determine the final pressure and temperature is preferable to simply selecting the final data point because the LSR reduces potential noise errors in the data gathered by the gauge 50 (FIG. 1), which may be attributable to mechanical systems (e.g., hydraulic or electrical motors), circulating fluid 14 in the wellbore 12 (FIG. 1), pressure disturbances generated by downhole mud pulsers, surface mud pumps, and the like. The noise may be evaluated by determining the standard deviation ("std. dev.") of the pressure or temperature ($\sigma_y$), such as by using Equation VII over the same period of time the LSR is performed using the same data $(x_i,y_i)$ with the results for a and b from Equations V and VI above:

$$\sigma_y=\sqrt{\frac{\sum(y_i-(a+b\cdot x_i))^2}{n-1}} \qquad \text{Equation VII}$$

Another method of analyzing buildup pressure from the drawdown-buildup sequence is to plot a pressure derivative value and observe a flow regime behavior. The pressure derivative used for flow regime analysis is different than the standard deviation of the pressure stability shown in Equation VI, although closely related. The flow regime assumption normally made for a formation tester 10 (FIG. 1) is hemispherical because the probe 30 (FIG. 1) positioned against the formation 13 (FIG. 1) creates a half of a sphere-shaped pressure profile during pretesting of drawdown and buildup. The pressure derivative based on a hemispherical flow regime may be determined using, for example, Equation VII:

$$\frac{dp}{dt} = -\sqrt{\phi C_t}\,\frac{q_{dd}}{4}\left(\frac{14{,}696}{\pi}\,\frac{\mu}{k_s}\right)^{\frac{3}{2}} \frac{t_p}{\Delta t(\Delta t + t_p)}\left(\frac{(\Delta t + t_p)^{\frac{3}{2}} - \Delta t^{\frac{3}{2}}}{t_p\sqrt{\Delta t}\,\sqrt{\Delta t + t_p}}\right), \quad \text{Equation VIII}$$

where, $$\frac{dp}{dt},$$

is the pressure derivative, Ø, is formation porosity (pore volume/total volume), $C_t$, is formation total compressibility (1/psi), $q_{dd}$, is drawdown flow rate ($cm^3$/sec), μ, is viscosity (cP), $k_s$, is spherical formation permeability (mD), Δt, is the buildup time (sec), and $t_p$, is the drawdown time (sec).

Equation VIII, as discussed above, is only an example of a means to determine the pressure derivative and other factors may be taken into account, such as storage effect, skin effect, anisotropy, and the like. This theoretical derivative, $$\frac{dp}{dt},$$

may also be compared against the measured stability and used as another measurement of data quality as shown in Equation IX below:

$$\Delta b = b - \frac{dp}{dt}, \quad \text{Equation IX}$$

where Δb is the difference between the slopes. Ideally the two derivatives or slopes would be very close and variations of either positive or negative magnitudes are an indication of the buildup quality.

Supercharging may be used as another quality parameter in the embodiments of the present disclosure. As used herein, the term "supercharging" and grammatical variants thereof (e.g., "supercharge," "supercharge pressure," "supercharge differential," and the like), refer to the difference between the measured pressure stability and the ideal pressure stability determined by drawdown mobility for a given formation 13 (FIG. 1). Pressure variations near the wellbore 12 (FIG. 1) are often influenced by a number of factors, such as mud filtrate invasion and mudcake formation.

Wellbore pressure is normally maintained at a pressure substantially greater than the formation pressure primarily to prevent production of formation fluids into the wellbore 12 (FIG. 1). Thus, the wellbore is exposed to hydrostatic pressure, and mud filtrate (e.g., from drilling fluid) immediately invades the near wellbore region when a producing zone is penetrated during drilling, for example. The process may be referred to as "static filtration." As the mudcake grows against the wellbore, it eventually stabilizes to a maximum thickness. Stabilization occurs as a result of the shearing action of the mud circulation in the wellbore, as well as mechanical action of tools in the wellbore, such as a rotating drill bit or drill pipe. This process may be referred to as "dynamic filtration." During these processes, a radial pressure gradient may be established, as shown in FIG. 4.

Figure 4:
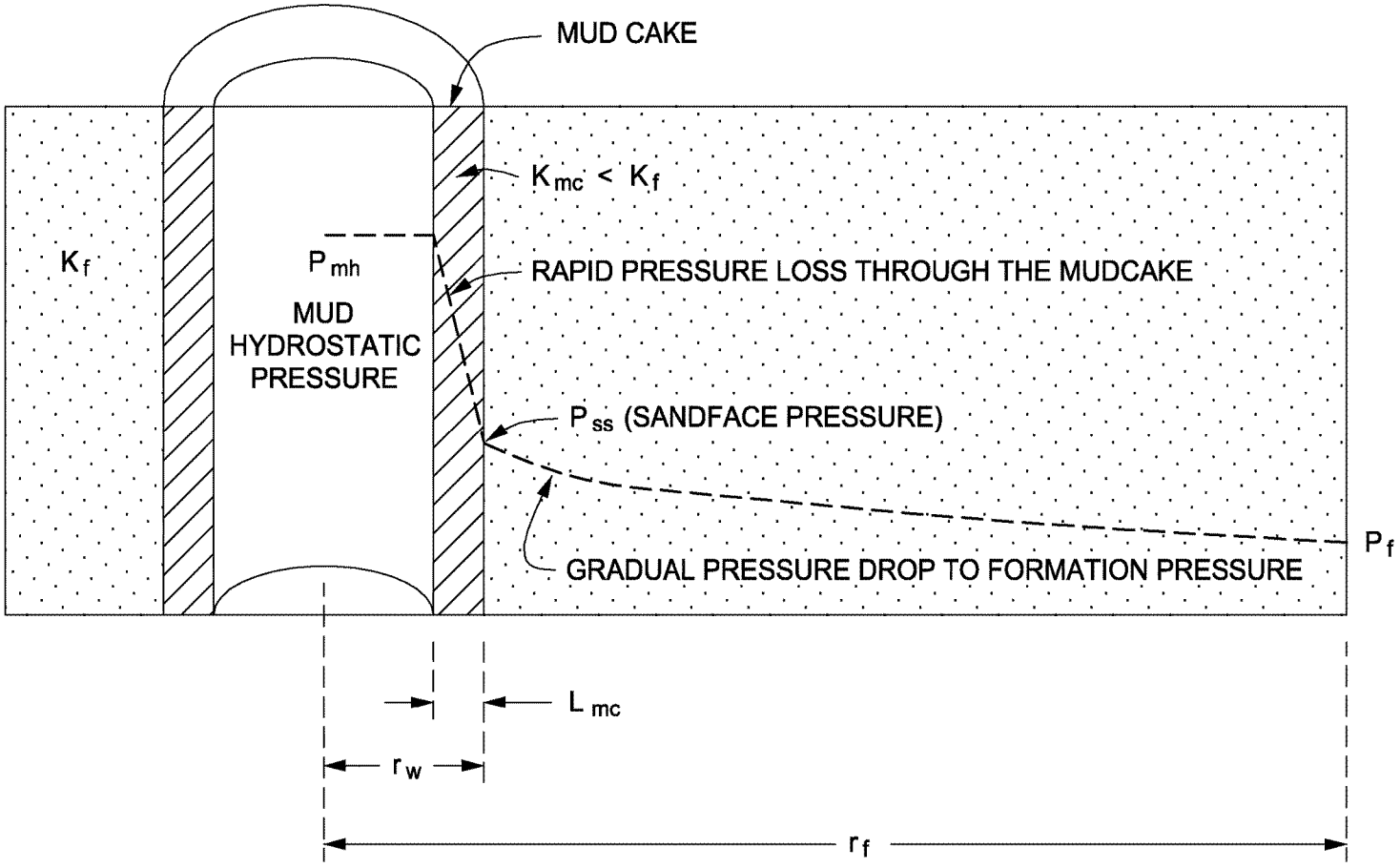
FIG. 4 is a diagram illustrating the effect of supercharge pressure in a wellbore.

As shown in FIG. 4, a mudcake is formed on the wall of a wellbore, where the mudcake permeability ($K_{mc}$) is less than the formation permeability ($K_f$). The pressure in the wellbore near the exposed surface of the mudcake is at hydrostatic pressure ($P_{mh}$=mud hydrostatic pressure). Filtration loss (e.g., mud filtrate invasion) across the mudcake drops rapidly and elevates the sandface pressure ($P_{ss}$), then gradually reduces in the formation, approaching formation pressure ($P_f$) some distance from the wellbore. In FIG. 4, $r_w$, is the wellbore radius, $r_f$, is the formation radius, and $L_{mc}$, is the mudcake thickness. The supercharge pressure differential ($\Delta P_{sc}$) may be defined as the difference between the sandface pressure ($P_{ss}$) just behind the mudcake and the initial formation pressure ($P_f$).

In estimating the supercharge pressure as a quality parameter for use in the methods described herein, several simplifying assumptions may be made: (1) that the static filtration time is short compared to the dynamic filtration period, (2) that wellbore conditions remain relatively unchanged during dynamic filtration (e.g., wellbore pressure and mudcake effectiveness), (3) single-phase Darcy flow with miscible filtrate invasion, and (4) radial invasion with infinite radial boundary. While multiphase immiscible invasion is not considered, the single phase assumption provides a first order estimate of invasion.

Using these assumptions, the pretest measurements, and log data, the supercharge pressure differential can be determined. The mudcake can be assumed to be relatively thin, compared to the wellbore radius (e.g., $L_{mc} \ll r_w$). The flow through the mudcake can be modeled as a linear Darcy flow with the pressure differential between the mud hydrostatic pressure ($P_{mh}$) and the sandface pressure ($P_{ss}$), and the supercharge pressure differential ($\Delta P_{sc}$) can be estimated according to Equation X:

$$\Delta P_{sc} = (P_{mh} - P_{ss})\frac{r_w K_{mc}}{2L_{mc}K_f}\ln\left[\frac{4K_f t_{inv}}{\gamma\phi\mu C_t r_w^2}\right], \quad \text{Equation X}$$

where $t_{inv}$, is the invasion time (hours), γ, is the exponential of Euler's constant ($e^r$=1.781), μ, is viscosity (cP), and $C_t$, is formation total compressibility (1/psi).

If pressure testing is performed soon after drilling, such as during LWD, static invasion may control. At the beginning of near wellbore invasion, the supercharge pressure increases rapidly as the mudcake forms because there is little sealing action until it is established. After the mudcake grows, the invasion slows and the near wellbore sandface pressure depletes as a result of the decreased invasion. As the mudcake effectiveness becomes relatively static, the near wellbore pressure converges to dynamic filtration. Dynamic filtration also typically controls when pressure testing is performed after the passage of time after drilling (e.g., about an hour or more).

Another quality value that may be used in scoring test quality based on the drawdown-buildup sequence may include the radius of investigation. As used herein, the term "radius of investigation" refers to the distance that characterizes how far a tool (e.g., a formation tester, a logging tool, and the like) measures into the formation from the axis of the tool or wellbore. In some instances, the radius of investigation may ($r_{inv}$) be determine using the simplified Equation XI:

$$r_{inv} = 0.029\sqrt{\frac{K_f}{\mu}\frac{t_{int}}{\phi C_t}}, \quad \text{Equation XI}$$

where $t_{int}$, is the transition time to pseudo-steady state (hours).

Equation IX takes into account the transition time to pseudo-steady state. Theoretically, this transition time may be observed in the drawdown, but the buildup is normally used because the pressure transient is less noisy. The transition to pseudo-steady state may be determined with a derivative plot in which infinitely acting flow transitions to either a constant pressure boundary or no-flow boundary. In some instances, however, transition time to pseudo-steady state is not observable during pretest drawdown-buildup sequences due to small drawdown pressure differentials and/or short duration buildup times. In such cases, the radius of investigation may also be determined in terms of drawdown mobility and drawdown duration, as shown in Equation X:

$$r_{inv} = 0.029\sqrt{\frac{M_{sdd}t_p}{\phi C_t}}, \quad \text{Equation XII}$$

where, $t_p$, is the drawdown time (sec).

A longer drawdown time may improve the radius of investigation. Drawdown time is also a parameter that can be controlled to improve the test quality, but it is dependent upon the formation quality (e.g., drawdown mobility) and pretest volume available in the formation tester 10 (i.e., the pretest chamber 48) (FIG. 1). For high drawdown mobilities (e.g., >100 mD/cP), faster rates are needed to create the pressure pulse, which results in shorter drawdown as a result of limited formation tester drawdown volume. For low drawdown mobilities (e.g., <1 mD/cP), the drawdown drops rapidly, even when using the slowest flow rate available, and may quickly exceed the formation tester's drawdown limit, resulting in a reduced drawdown time.

Using Equation II above, the following Equation XIII for radius on investigation may also be used:

$$r_{inv} = 0.029\sqrt{\frac{V_{pt}C_{pf}}{\Delta P_{dd}\phi C_t}}, \quad \text{Equation XIII}$$

where $V_{pt}$, is the pretest volume, and $\Delta P_{dd}$, is the drawdown pressure. These variables are directly related to the formation testing tool's capabilities and reservoir conditions. Accordingly, the radius of investigation estimation based on Equations XII or XIII takes into account the relative values of the test parameters chosen and the capabilities of the formation tester (or other tool) used.

In some embodiments herein, the present disclosure provides methods for determining the quality of data gathered in a wellbore in a subterranean formation. A wellbore measurement is taken (e.g., drawdown pressure, buildup pressure, buildup temperature, formation permeability, and the like) and a measured quality value is determined from the wellbore measurement (e.g., any of the quality values described above such as buildup stability or radius of investigation, or any other quality value). The measured quality value is then scored and associated with an attribute that defines and describes the quality of the initial wellbore measurement.

For example in some embodiments, the present disclosure provides a method of determining the quality of data gathered in a wellbore in a subterranean formation by first acquiring a wellbore measurement ("WM") form at least on depth in the wellbore and the subterranean formation. The WM may be made using a formation tester, for example. From one or more wellbore measurements, a measured quality value ("MQV") is determined as demonstrated earlier such as stability, radius of investigation, supercharge, and others. The MQV is then assigned a threshold value ("TV") defining the value of the MQV that is deemed acceptable. Although the TV defines an acceptable MQV, even values below the acceptable value may be evaluated using the methods described herein such that the information, along with other testing and/or quality information, may be evaluated by an analyst to make an informed decision about the quality of the test point. The MQV is also assigned a range value ("RV") based on geometric scaling of the TV, where the RV defines the limits of the MQV above and below the TV. Thereafter, a score value ("SV") is calculated based on the MQV, the TV, and the RV, wherein the SV is a number between 0 and 2*TV, corresponding to the wellbore measurements' quality ranging from a low quality to a high quality, respectively.

The TV and the RV is based on user input and is dependent upon at least the type of MQV being used. For example the TV for a supercharge pressure or pressure stability MQV may be below 1, whereas the TV for a drawdown mobility or radius of investigation MQV may be greater than 1, or even greater. The RV may be broad or narrow, depending on the particular MQV, the requirements of the particular operation to be performed, the requirements of the wellbore operator, and the like. Regardless of the user input TV and RV values, the scoring methodology of the present disclosure is equally applicable and is not dependent upon these subjective inputs.

The SV of the present disclosure may be determined using either of Equation XIV or XV, below, depending on the TV and RV values selected by a user:

$$SV = \frac{TV}{2}\left(1 - \frac{\log\left(\frac{|MQV|}{TV}\right)}{\log(RV)}\right), \quad \text{Equation XIV}$$

$$\text{if } \left(\frac{TV}{RV}\right) \le TV \le (TV * RV)$$

$$SV = \frac{TV}{2}\left(1 + \frac{\log\left(\frac{|MQV|}{TV}\right)}{\log(RV)}\right), \quad \text{Equation XV}$$

$$\text{if } \left(\frac{TV}{RV}\right) \ge TV \ge (TV * RV)$$

In some embodiments, the MQV may further be assigned a weighting factor ("WF"), such as where multiple WM's are measured or determined from the data. The WF determines the relative weight of individual MQV's in a final overall (i.e., averaged) weighted score value ("WSV") of multiple MQV's of the same type. The WF may be a number between 0 and 1, wherein 0 is weighted the lowest and 1 is weighted the highest. The higher the weighting factor, the higher the importance of the MQV and SV is relative to other MQV and SV. By using the WF for each SV, a single normalized WSV can be determined considering all of the SV considered. The WSV may then be determined using Equation XVI:

$$WSV = \sum_{i=1,n}\left(SV_i \frac{WF_i}{\sum_{i=1,n} WF_i}\right), \qquad \text{Equation XVI}$$

where, $SV_i$, is the SV of the individual MQV, $WF_i$, is the WF of each $SV_i$ of the individual MQV, and n is the total number of individual MQVs used to determine a SV.

In some embodiments, an invalid quality attribute may be assigned to the WM when the SV is less than the TV, and a valid quality attribute may be assigned to the WM when the SV is greater than or equal to the TV. The SV may be further stratified to provide other more detailed quality attributes. The amount of stratification may depend on the particular user and, in some instances, may be a five tiered stratification, wherein the quality of the MW is graded above the TV and below the TV in two tiers each. For example, in one embodiment, wherein a high quality attribute is assigned to the WM when the SV is between 2*TV and greater than 1.75*TV, a good quality attribute is assigned to the WM when the SV is between 1.75*TV and greater than 1.25*TV, a valid quality attribute is assigned to the WM when the SV is between 1.25*TV and greater than 0.75*TV, a fair quality attribute is assigned to the WM when the SV is between 0.75*TV and greater than 0.5*TV, and a low quality attribute is assigned to the WM when the SV is between 0.5*TV and 0. The terms "valid," "invalid," "high quality," "good quality," "fair quality," and "low quality" are merely illustrative and any other terms used to connote an equivalent quality stratification may be used, without departing from the scope of the present disclosure.

The WMs for use in the methods described herein may be any measurements taken downhole, including those made by a formation tester 10 (FIG. 1). Such WMs are used to determine the MQVs of the present disclosure and, as discussed above, may include measurements derived from drawdown-buildup sequences (i.e., drawdown pressure, buildup pressure, and buildup temperature). WMs that may be used in the scoring methodology of the present disclosure may include, but are not limited to, drawdown pressure (including final drawdown pressure), buildup pressure (including final buildup pressure), buildup stability (including final buildup stability), formation total compressibility, isotropic formation permeability, spherical formation permeability, mudcake permeability, mudcake thickness, wellbore mud hydrostatic pressure, drawdown flow rate, mud filtrate invasion rate, wellbore radius, buildup time, drawdown time, transition time to pseudo-steady state, invasion time, viscosity, formation porosity, and any combination thereof.

The MQV may be any quality value (e.g., measurement or estimate) that may be gleaned from a WM and indicative of the quality of the WM test point, and thus its reliability. In some embodiments, as described in detail above, the MQV may include, but is not limited to, drawdown mobility, pressure stability, pressure stability standard deviation, temperature stability, temperature stability standard deviation, supercharge pressure, radius of investigation, and any combination thereof.

Referring now to FIG. 5, illustrated is a set of WMs and associated MQV, TV, RV, and WF for each of the WMs. FIG. 5 is merely an illustration and the TV, RV, and WF values selected may be based on user input and wholly different from those displayed in FIG. 5, without departing from the scope of the present disclosure, as the disclosed equations herein remain applicable. Based on real values observed in the field, quality attributes of high quality, good quality, valid, fair quality, and low quality are displayed. Additionally, the descriptor quality attributes of mud set, tight, low permeability (or low perm), supercharged, and a combination of supercharged and low permeability, are shown as a user input rating that qualifies a SV to be assigned one of those descriptor quality attributes.

In some embodiments, as shown in FIG. 5, for example, the TV, RV, WF, SV, and/or WSV may be graphically displayed on a medium including, but not limited to, a spreadsheet, a table, a plot, and any combination thereof. The WM may also be graphically displayed. In some embodiments, the medium may include a computer with a standard processor, which may comprise a storage medium where the MW, MQV, RV, and/or TV may be input by an operator and the SV or WSV calculated automatically, such as by setting up a spreadsheet to automatically perform the calculations described in the equations of the present disclosure.

In some embodiments, the displayed SV or WSV is given a graphic designation, or a particular quality attribute derived from the SV or WSV is given a graphic designation. Such a graphic designation may be used by an operator or analyst to quickly assess the quality of the WM data of a particular test point (e.g., at a particular depth from a plurality of drawdown-buildup sequences). In some embodiments, the graphic designation is a color value, a pattern, a combination thereof, or any other graphic designation that may be uniquely assigned to a particular quality attribute or SV.

For example, in some embodiments, the graphic designation is a color value based on a color spectrum, for example, from dark green for a high quality attribute, light green for a good quality attribute, yellow for a valid quality attribute, orange for a fair quality attribute, and red for a low quality attribute (i.e., a spectrum changing from green for a high quality attribute of 2*SV, to yellow for a valid quality attribute of TV, to red for an SV of 0). Any other color spectrum may also be used without departing from the scope of the present disclosure, so long as the color values are distinguishable (i.e., are unique for particular SV or WSVs, or assigned quality attributes). Likewise, patterns or shading may be used to quickly visualize the quality of the test data graphically displayed. In some embodiments, the graphic designation may be automatically displayed on the medium (e.g., when the medium is a computer spreadsheet).

In some embodiments, quality attributes beyond valid, invalid, high to low, etc. (e.g., "enhanced quality attributes" or "descriptor quality attributes") may be assigned to a WM based on the scoring methodology described herein that are linked to a descriptor of the formation itself. FIG. 6 depicts these additional quality attributes graphically displayed on a medium including, but not limited to, a spreadsheet, a table, a plot, and any combination thereof. For example, a formation tester 10 (FIG. 1) may not have an adequate seal resulting in a false reading that is near the hydrostatic well bore pressure, called "mud set." In this case, very little overbalance (i.e., where the amount of pressure (or force per unit area) in the wellbore exceeds the pressure of fluids in the formation, and may also describe instances where the probe 30 (FIG. 1) fails to seal against the formation 13 (FIG. 1). A test may be considered supercharged (i.e., where the mudcake fails to adequately hold drilling fluid in a wellbore and the drilling fluid penetrates the formation), tight or low perm (as described above), and combinations of these (e.g., low perm and supercharged). The scoring methodology described herein may be used to assign such quality attributes to particular WM based on user input values associated with the actual MQV, where a MQV below or above the user input value results in assigning to a WM a descriptor quality attribute (a type of quality attribute, as described herein), such as the ones disclosed herein and shown in FIG. 6. Other descriptor quality attributes may also be assigned based MQVs of the present disclosure, without departing from the scope of the present disclosure and the values shown in FIG. 6 are merely illustrative.

For example, in one embodiment, the MQV may comprise an overbalanced measurement, along with an associated mud set quality attribute indicating overbalance. For example, when the measured pressure is near the wellbore mud hydrostatic pressure, in setting the "mud set" quality attribute. The "mud set" quality may be determined based on an overbalance pressure MQV. The overbalance pressure MQV is determined by the difference between the wellbore hydrostatic pressure and the buildup pressure measurements, wherein an overbalance indicates a "mud set" quality attribute, which may indicate low quality probe setting during testing. The overbalance pressure MQV may be determined in combination with any other MQV. Other pressure measurements may also be considered. In other embodiments, the MQV may comprise drawdown mobility and a low permeability value may be assigned to the drawdown mobility, along with a low permeability quality value describing the formation. In other embodiments, the MQV may comprise drawdown mobility and a tight permeability value may be assigned to the drawdown mobility, along with a tight permeability quality value describing the formation. In yet other embodiments, the MQV may be a supercharge pressure and a supercharged value may be assigned to the supercharge pressure, along with an associated supercharged quality attribute indicating a particular heightened supercharged formation. These additional quality attributes do not foreclose use of more general quality attributes in addition to or in lieu of the more descriptive attributes (i.e., either/or or both may be used). Indeed, in some embodiments, a variety of quality attributes for any given MQV may be used, without departing from the scope of the present disclosure. Moreover, a user may define additional quality attributes using the scoring methodology described herein, without departing from the scope of the present disclosure.

In practice, when an analyst observes an unfavorable SV or WSV, or a poor quality attribute (which may have a graphic designation assigned therewith), the steps of retesting described in the embodiments herein may take place at the particular location in the wellbore. For example, retesting may be performed when the quality attribute is a fair quality or low quality (i.e., below valid). In other cases, the analyst may decide that the portion of the wellbore at that depth is not suitable for further development (e.g., stimulation and production).

Pressure gradient determination and analysis in subterranean formation wellbores is vital in obtaining information concerning the effects of flow rate, pipe size, and pressure relationships, oil and water locations, oil-and-water contact points or locations ("contact point calculation"), and the like; accordingly, the accuracy of such gradient analysis is also vital. The term "pressure gradient" refers to a change in pressure per unit of depth or distance, usually in units of psi/ft or kilopascals/meter ("kPa/m"). Pressure increases predictably with depth in areas of formal pressure and deviations from normal pressure are described as high or low pressure. Gradient analysis can be used to determine oil-and-gas contact points and other information about the characteristics of a subterranean formation, and is typically presented in the form of a graph or chart.

Gradient analysis and contact point calculations may be enhanced using the methods and systems of the present disclosure. For example, where the MQV is pressure stability and the WM is assigned a valid quality attribute (or any quality attribute greater than valid, where gradient or stepwise quality attributes are used, as provided herein) because the SV is greater than or equal to the TV, that data may be included in gradient analysis and contact point calculation. Alternatively, wherein the MQV is pressure stability and the WM is assigned an invalid quality attribute (or any quality attribute less than invalid, where gradient or stepwise quality attributes are used, as provided herein), the data may be excluded in gradient analysis and contact point calculations. Still alternatively, when the MQV is pressure stability any or all valid quality attribute data may be included and any or all invalid quality attribute data may be excluded from gradient analysis and contact point calculation, in any combination, and including gradient or stepwise attributes.

By using the scoring methodology described herein to selectively choose data to include in gradient analysis and contact point calculations, the information gleaned from such analysis is reliably enhanced and more accurate. Increasing the accuracy thus increases the calculations and assumptions based on the gradient analysis and contact point calculations for downstream operations.

Embodiments disclosed herein include:

Embodiment A

A method for determining the quality of data gathered in a wellbore in a subterranean formation, the method comprising: (a) collecting a formation fluid sample in the wellbore in the subterranean formation using a formation tester for receiving the formation fluid, wherein the formation tester is lowered to at least one depth in the wellbore in the subterranean formation by a conveyor; (b) acquiring a wellbore measurement ("WM") from the least one depth with the formation tester; (c) determining from the WM a measured quality value ("MQV"); (d) assigning a threshold value ("TV") to the MQV; (e) assigning a range value ("RV") to the MQV, based on geometric scaling of the TV, the RV defining the limits of the MQV above and below the TV; and (f) calculating a score value ("SV") based on the MQV, the TV, and the RV, wherein the SV is a number between 0 and 2*TV, and wherein the quality of the WM increases as the SV increases.

Embodiment A may have one or more of the following additional elements in any combination:

Element A1: Wherein the score value is determined using the formula:

$$SV = \frac{TV}{2}\left(1 - \frac{\log\left(\frac{|MQV|}{TV}\right)}{\log(RV)}\right),$$

$$\text{if: } \left(\frac{TV}{RV}\right) \le TV \le (TV * RV).$$

Element A2: Wherein the score value is determined using the formula:

$$SV = \frac{TV}{2}\left(1 + \frac{\log\left(\frac{|MQV|}{TV}\right)}{\log(RV)}\right),$$

$$\text{if: } \left(\frac{TV}{RV}\right) \ge TV \ge (TV * RV).$$

Element A3: Wherein a quality attribute is assigned to the WM based on the SV, and an invalid quality attribute is assigned to the WM when the SV is less than the TV, and a valid quality attribute is assigned to the WM when the SV is greater than or equal to the TV.

Element A4: Wherein a quality attribute is assigned to the WM based on the SV, and a high quality attribute is assigned to the WM when the SV is between 2*TV and greater than 1.75*TV, a good quality attribute is assigned to the WM when the SV is between 1.75*TV and greater than 1.25*TV, a valid quality attribute is assigned to the WM when the SV is between 1.25*TV and greater than 0.75*TV, a fair quality attribute is assigned to the WM when the SV is between 0.75*TV and greater than 0.5*TV, and a low quality attribute is assigned to the WM when the SV is between 0.5*TV and 0.

Element A5: Wherein a quality attribute is assigned to the WM based on the SV.

Element A6: Wherein the WM is selected from the group consisting of drawdown pressure, buildup pressure, buildup stability, formation total compressibility, isotropic formation permeability, spherical formation permeability, mudcake permeability, mudcake thickness, wellbore mud hydrostatic pressure, drawdown flow rate, mud filtrate invasion rate, wellbore radius, buildup time, drawdown time, transition time to pseudo-steady state, invasion time, viscosity, formation porosity, and any combination thereof.

Element A7: Wherein the MQV is selected from the group consisting of drawdown mobility, pressure stability, pressure stability standard deviation, temperature stability, temperature stability standard deviation, supercharge pressure, radius of investigation, overbalance pressure, and any combination thereof.

Element A8: Wherein the MQV comprises an overbalance pressure determined by the difference between wellbore mud hydrostatic pressure and buildup pressure, and further comprising assigning an "mud set" quality attribute to the overbalance pressure MQV.

Element A9: Wherein the MQV comprises drawdown mobility, and further comprising assigning a low permeability value to the drawdown mobility and an associated low permeability quality attribute.

Element A10: Wherein the MQV comprises drawdown mobility, and further comprising assigning a tight permeability value to the drawdown mobility and an associated tight permeability quality attribute.

Element A11: Wherein the MQV comprises supercharge pressure, and further comprising assigning a supercharged value to the supercharge pressure and an associated supercharged quality attribute.

Element A12: Wherein the MQV comprises pressure stability, wherein an invalid quality attribute is assigned to the WM when the SV is less than the TV, and a valid quality attribute is assigned to the WM when the SV is greater than or equal to the TV, wherein the MW is included in a pressure gradient analysis and/or contact point calculation if the MW is assigned a valid quality attribute, and wherein the accuracy of the pressure gradient analysis and/or contact point calculation is increased by including the valid WM.

Element A13: wherein the MQV comprises pressure stability, wherein an invalid quality attribute is assigned to the WM when the SV is less than the TV, and a valid quality attribute is assigned to the WM when the SV is greater than or equal to the TV, and wherein the MW is excluded in a pressure gradient analysis and/or contact point calculation if the MW is assigned a valid quality attribute, and wherein the accuracy of the pressure gradient analysis and/or contact point calculation is increased by excluding the invalid WM.

By way of non-limiting example, exemplary combinations applicable to A include: A with A1 and A2; A with A1, A5, and A13; A with A3, A6, A7, and A9; A with A4 and A12; A with A8 and A12; A with A4, A5, and A9; A with A9, A10, and A11; A with A12 and A13.

Embodiment B

A method for determining the quality of data gathered in a wellbore in a subterranean formation, the method comprising: (a) collecting a formation fluid sample in the wellbore in the subterranean formation using a formation tester for receiving the formation fluid, wherein the formation tester is lowered to at least one depth in the wellbore in the subterranean formation by a conveyor; (b) acquiring a wellbore measurement ("WM") from the least one depth with the formation tester; (c) determining from the WM a measured quality value ("MQV"); (d) assigning a threshold value ("TV") to the MQV; (e) assigning a range value ("RV") to the MQV, based on geometric scaling of the TV, the RV defining the limits of the MQV above and below the TV; (f) calculating a score value ("SV") based on the MQV, the TV, and the RV, wherein the SV is a number between 0 and 2*TV, and wherein the quality of the WM increases as the SV increases; (g) assigning a weighting factor ("WF") to the MQV, the WF being a number between 0 and 1, wherein 0 is weighted the lowest and 1 is weighted the highest and; (h) calculating a weighted score value ("WSV") for the wellbore measurement based on the formula:

$$WSV = \sum_{i=1,n}\left(SV_i \frac{WF_i}{\sum_{i=1,n} WF_i}\right),$$

wherein $WF_i$ is an individual WF for the $SV_i$, the SV for an individual MQV, and n is the number of individual MQVs and SVs.

Embodiment B may have one or more of the following additional elements in any combination:

Element B1: Wherein the score value is determined using the formula:

$$SV = \frac{TV}{2}\left(1 - \frac{\log\left(\frac{|MQV|}{TV}\right)}{\log(RV)}\right),$$

-continued $$\text{if: } \left(\frac{TV}{RV}\right) \leq TV \leq (TV * RV).$$

Element B2: Wherein the score value is determined using the formula:

$$SV = \frac{TV}{2}\left(1 + \frac{\log\left(\frac{|MQV|}{TV}\right)}{\log(RV)}\right),$$

$$\text{if: } \left(\frac{TV}{RV}\right) \geq TV \geq (TV * RV).$$

Element B3: Wherein a quality attribute is assigned to the WM based on the SV, and an invalid quality attribute is assigned to the WM when the SV is less than the TV, and a valid quality attribute is assigned to the WM when the SV is greater than or equal to the TV.

Element B4: Wherein a quality attribute is assigned to the WM based on the SV, and a high quality attribute is assigned to the WM when the SV is between 2*TV and greater than 1.75*TV, a good quality attribute is assigned to the WM when the SV is between 1.75*TV and greater than 1.25*TV, a valid quality attribute is assigned to the WM when the SV is between 1.25*TV and greater than 0.75*TV, a fair quality attribute is assigned to the WM when the SV is between 0.75*TV and greater than 0.5*TV, and a low quality attribute is assigned to the WM when the SV is between 0.5*TV and 0.

Element B5: Wherein a quality attribute is assigned to the WM based on the SV.

Element B6: Wherein the WM is selected from the group consisting of drawdown pressure, buildup pressure, buildup stability, formation total compressibility, isotropic formation permeability, spherical formation permeability, mudcake permeability, mudcake thickness, wellbore mud hydrostatic pressure, drawdown flow rate, mud filtrate invasion rate, wellbore radius, buildup time, drawdown time, transition time to pseudo-steady state, invasion time, viscosity, formation porosity, and any combination thereof.

Element B7: Wherein the MQV is selected from the group consisting of drawdown mobility, pressure stability, pressure stability standard deviation, temperature stability, temperature stability standard deviation, supercharge pressure, radius of investigation, overbalance pressure, and any combination thereof.

Element B8: Wherein the MQV comprises an overbalance pressure determined by the difference between wellbore mud hydrostatic pressure and buildup pressure, and further comprising assigning an "mud set" quality attribute to the overbalance pressure MQV.

Element B9: Wherein the MQV comprises drawdown mobility, and further comprising assigning a low permeability value to the drawdown mobility and an associated low permeability quality attribute.

Element B10: Wherein the MQV comprises drawdown mobility, and further comprising assigning a tight permeability value to the drawdown mobility and an associated tight permeability quality attribute.

Element B11: Wherein the MQV comprises supercharge pressure, and further comprising assigning a supercharged value to the supercharge pressure and an associated supercharged quality attribute.

Element B12: Wherein the MQV comprises pressure stability, wherein an invalid quality attribute is assigned to the WM when the SV is less than the TV, and a valid quality attribute is assigned to the WM when the SV is greater than or equal to the TV, wherein the MW is included in a pressure gradient analysis and/or contact point calculation if the MW is assigned a valid quality attribute, and wherein the accuracy of the pressure gradient analysis and/or contact point calculation is increased by including the valid WM.

Element B13: wherein the MQV comprises pressure stability, wherein an invalid quality attribute is assigned to the WM when the SV is less than the TV, and a valid quality attribute is assigned to the WM when the SV is greater than or equal to the TV, and wherein the MW is excluded in a pressure gradient analysis and/or contact point calculation if the MW is assigned a valid quality attribute, and wherein the accuracy of the pressure gradient analysis and/or contact point calculation is increased by excluding the invalid WM.

Embodiments B may have one or more of the following additional elements in any combination:

By way of non-limiting example, exemplary combinations applicable to B include: B with B2, B4, and B6; B with B12 and B13; B with B4, B8, and B10; B with B11, B12, and B13; B with B1, B3, B6, and B8; B5 and B10; B with B5, B8, and B13; B with B1 and B2.

Embodiment C

A method for determining the quality of data gathered in a wellbore in a subterranean formation, the method comprising: (a) acquiring a wellbore measurement from at least one depth in the wellbore in the subterranean formation; (b) determining from the wellbore measurement a measured quality value ("MQV"); (c) assigning a threshold value ("TV") to the MQV; (d) assigning a range value ("RV") to the MQV, based on geometric scaling of the threshold value; (e) calculating a score value for the wellbore measurement based on geometric scaling of the TV, the RV defining the limits of the MQV above and below the TV; and (d) calculating a score value ("SV") based on the MQV, the TV, and the RV, wherein the SV is a number between 0 and 2*TV, corresponding to an increase in the quality of the wellbore measurement's as the SV increases; and (f) graphically displaying a value selected from the group consisting of the MQV, TV, RV, SV, and any combination thereof on a medium selected from the group consisting of a spreadsheet, a table, a plot, and any combination thereof.

Embodiment C may have one or more of the following additional elements in any combination:

Element C1: Wherein the score value is determined using the formula:

$$SV = \frac{TV}{2}\left(1 - \frac{\log\left(\frac{|MQV|}{TV}\right)}{\log(RV)}\right),$$

$$\text{if: } \left(\frac{TV}{RV}\right) \leq TV \leq (TV * RV).$$

Element C2: Wherein the score value is determined using the formula:

$$SV = \frac{TV}{2}\left(1 + \frac{\log\left(\frac{|MQV|}{TV}\right)}{\log(RV)}\right),$$

-continued $$\text{if: } \left(\frac{TV}{RV}\right) \geq TV \geq (TV * RV).$$

Element C3: Wherein a quality attribute is assigned to the WM based on the SV, and an invalid quality attribute is assigned to the WM when the SV is less than the TV, and a valid quality attribute is assigned to the WM when the SV is greater than or equal to the TV.

Element C4: Wherein a quality attribute is assigned to the WM based on the SV, and a high quality attribute is assigned to the WM when the SV is between 2*TV and greater than 1.75*TV, a good quality attribute is assigned to the WM when the SV is between 1.75*TV and greater than 1.25*TV, a valid quality attribute is assigned to the WM when the SV is between 1.25*TV and greater than 0.75*TV, a fair quality attribute is assigned to the WM when the SV is between 0.75*TV and greater than 0.5*TV, and a low quality attribute is assigned to the WM when the SV is between 0.5*TV and 0.

Element C5: Wherein a quality attribute is assigned to the WM based on the SV.

Element C6: Wherein the WM is selected from the group consisting of drawdown pressure, buildup pressure, buildup stability, formation total compressibility, isotropic formation permeability, spherical formation permeability, mudcake permeability, mudcake thickness, wellbore mud hydrostatic pressure, drawdown flow rate, mud filtrate invasion rate, wellbore radius, buildup time, drawdown time, transition time to pseudo-steady state, invasion time, viscosity, formation porosity, and any combination thereof.

Element C7: Wherein the MQV is selected from the group consisting of drawdown mobility, pressure stability, pressure stability standard deviation, temperature stability, temperature stability standard deviation, supercharge pressure, radius of investigation, overbalance pressure, and any combination thereof.

Element C8: Wherein the MQV comprises an overbalance pressure determined by the difference between wellbore mud hydrostatic pressure and buildup pressure, and further comprising assigning an "mud set" quality attribute to the overbalance pressure MQV.

Element C9: Wherein the MQV comprises drawdown mobility, and further comprising assigning a low permeability value to the drawdown mobility and an associated low permeability quality attribute.

Element C10: Wherein the MQV comprises drawdown mobility, and further comprising assigning a tight permeability value to the drawdown mobility and an associated tight permeability quality attribute.

Element C11: Wherein the MQV comprises supercharge pressure, and further comprising assigning a supercharged value to the supercharge pressure and an associated supercharged quality attribute.

Element C12: Wherein the MQV comprises pressure stability, wherein an invalid quality attribute is assigned to the WM when the SV is less than the TV, and a valid quality attribute is assigned to the WM when the SV is greater than or equal to the TV, wherein the MW is included in a pressure gradient analysis and/or contact point calculation if the MW is assigned a valid quality attribute, and wherein the accuracy of the pressure gradient analysis and/or contact point calculation is increased by including the valid WM.

Element C13: wherein the MQV comprises pressure stability, wherein an invalid quality attribute is assigned to the WM when the SV is less than the TV, and a valid quality attribute is assigned to the WM when the SV is greater than or equal to the TV, and wherein the MW is excluded in a pressure gradient analysis and/or contact point calculation if the MW is assigned a valid quality attribute, and wherein the accuracy of the pressure gradient analysis and/or contact point calculation is increased by excluding the invalid WM.

Element C14: Wherein the SV is assigned a graphic designation.

Element C15: Wherein the SV is assigned a quality attribute and the quality attribute is assigned a graphic designation.

Element C16: Further comprising: assigning a weighting factor ("WF") to the MQV, the WF being a number between 0 and 1, wherein 0 is weighted the lowest and 1 is weighted the highest; calculating a weighted score value ("WSV") for the wellbore measurement based on the formula:

$$WSV = \sum_{i=1,n}\left(SV_i \frac{WF_i}{\sum_{i=1,n} WF_i}\right),$$

wherein $WF_i$ is an individual WF for the $SV_i$, the SV for an individual MQV, and n is the number of individual MQVs and SVs.

Element C17: Further comprising: assigning a weighting factor ("WF") to the MQV, the WF being a number between 0 and 1, wherein 0 is weighted the lowest and 1 is weighted the highest; calculating a weighted score value ("WSV") for the wellbore measurement based on the formula:

$$WSV = \sum_{i=1,n}\left(SV_i \frac{WF_i}{\sum_{i=1,n} WF_i}\right),$$

wherein $WF_i$ is an individual WF for the $SV_i$, the SV for an individual MQV, and n is the number of individual MQVs and SVs, and graphically displaying the WSV on the medium.

By way of non-limiting example, exemplary combinations applicable to C include: C with C1, C4, and C17; C with C2, C8, C9, and C16; C with C13, C14, and C15; C with C3, C5, C8, and C10; C with C11 and C12; C with C12 and C13; C with C6, C15, and C16; C with C1 and C16.

"Exemplary" is used exclusively herein to mean "serving as an example, instance, or illustration." Any embodiment described herein as exemplary is not to be construed as preferred or advantageous over other embodiments.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces.

The invention claimed is:

1. A method comprising:

collecting a formation fluid sample in a wellbore in a subterranean formation using a formation tester for receiving the formation fluid sample, wherein the formation tester is lowered to at least one depth in the wellbore in the subterranean formation by a conveyor;

acquiring, independent of the formation fluid sample, a wellbore measurement ("WM") from the at least one depth with the formation tester;

determining from the WM a measured quality value ("MQV");

assigning a threshold value ("TV") and a range value ("RV") to the MQV, the RV being assigned based on geometric scaling of the TV, and the RV defining limits of the MQV above and below the TV;

calculating a score value ("SV") for the WM based on the MQV, the TV, and the RV, wherein the SV is a number between 0 and 2*TV, and the SV indicates a quality of the WM;

providing an indication of the SV calculated for the WM to indicate a quality associated with the collected formation fluid sample; and initiating another acquisition, by the formation tester, another WM from the at least one depth in the wellbore when the SV indicates that the quality of the WM is below a validity threshold.

2. The method of claim 1, wherein the score value is determined using a formula comprising:

$$SV = \frac{TV}{2}\left(1 - \frac{\log\left(\frac{|MQV|}{TV}\right)}{\log(RV)}\right),$$

$$\text{if: } \left(\frac{TV}{RV}\right) \le TV \le (TV * RV).$$

3. The method of claim 1, wherein the score value is determined using a formula comprising:

$$SV = \frac{TV}{2}\left(1 + \frac{\log\left(\frac{|MQV|}{TV}\right)}{\log(RV)}\right),$$

$$\text{if: } \left(\frac{TV}{RV}\right) \ge TV \ge (TV * RV).$$

4. The method of claim 1, wherein a quality attribute is assigned to the WM based on the SV, and the WM is acquired before the formation fluid sample is collected.

5. The method of claim 4, wherein an invalid quality attribute is assigned to the WM when the SV is less than the TV, and a valid quality attribute is assigned to the WM when the SV is greater than or equal to the TV.

6. The method of claim 4, wherein a high quality attribute is assigned to the WM when the SV is between 2*TV and greater than 1.75*TV, a good quality attribute is assigned to the WM when the SV is between 1.75*TV and greater than 1.25*TV, a valid quality attribute is assigned to the WM when the SV is between 1.25*TV and greater than 0.75*TV, a fair quality attribute is assigned to the WM when the SV is between 0.75*TV and greater than 0.5*TV, and a low quality attribute is assigned to the WM when the SV is between 0.5*TV and 0.

7. The method of claim 1, wherein the WM is selected from the group consisting of drawdown pressure, buildup pressure, buildup stability, formation total compressibility, isotropic formation permeability, spherical formation permeability, mudcake permeability, mudcake thickness, wellbore mud hydrostatic pressure, drawdown flow rate, mud filtrate invasion rate, wellbore radius, buildup time, drawdown time, transition time to pseudo-steady state, invasion time, viscosity, formation porosity, and any combination thereof.

8. The method of claim 1, wherein the MQV is selected from the group consisting of drawdown mobility, pressure stability, pressure stability standard deviation, temperature stability, temperature stability standard deviation, supercharge pressure, radius of investigation, overbalance pressure, and any combination thereof.

9. The method of claim 1, wherein the MQV comprises an overbalance pressure determined by a difference between wellbore mud hydrostatic pressure and buildup pressure, and further comprising assigning a mud set quality attribute to the MQV comprising the overbalance pressure.

10. The method of claim 1, wherein the MQV comprises drawdown mobility, and further comprising assigning a low permeability value to the drawdown mobility and an associated low permeability quality attribute.

11. The method of claim 1, wherein the MQV comprises drawdown mobility, and further comprising assigning a tight permeability value to the drawdown mobility and an associated tight permeability quality attribute.

12. The method of claim 1, wherein the MQV comprises supercharge pressure, and further comprising assigning a supercharged value to the supercharge pressure and an associated supercharged quality attribute.

13. The method of claim 1, wherein the MQV comprises pressure stability, wherein an invalid quality attribute is assigned to the WM when the SV is less than the TV, and a valid quality attribute is assigned to the WM when the SV is greater than or equal to the TV, wherein the WM is included in a pressure gradient analysis and/or contact point calculation when the WM is assigned the valid quality attribute, and wherein an accuracy of the pressure gradient analysis and/or contact point calculation is increased by including the WM when the WM is assigned the valid quality attribute.

14. The method of claim 1, wherein the MQV comprises pressure stability, wherein an invalid quality attribute is assigned to the WM when the SV is less than the TV, and a valid quality attribute is assigned to the WM when the SV is greater than or equal to the TV, and wherein the WM is excluded in a pressure gradient analysis and/or contact point calculation when the WM is assigned the valid quality attribute, and wherein an accuracy of the pressure gradient analysis and/or contact point calculation is increased by excluding the WM when the WM is assigned the invalid quality attribute.

15. The method of claim 1, further comprising:

assigning a weighting factor ("WF") to the MQV, the WF being a number between 0 and 1, wherein 0 is weighted the lowest and 1 is weighted the highest;

calculating a weighted score value ("WSV") for the WM based on a formula comprising:

$$WSV = \sum_{i=1,n}\left(SV_i \frac{WF_i}{\sum_{i=1,n} WF_i}\right),$$

wherein $WF_i$ is an individual WF for the $SV_i$, the SV for an individual MQV, and n is a number of individual MQVs and SVs; and providing an indication of the calculated WSV for the WM.

16. A method comprising:

acquiring, by a formation tester, a wellbore measurement from at least one depth in a wellbore in a subterranean formation, the wellbore measurement having a unit of measurement;

determining from the wellbore measurement a measured quality value ("MQV");

assigning a threshold value ("TV") and a range value ("RV") to the MQV, the RV being assigned based on geometric scaling of the TV, and the RV defining limits of the MQV above and below the TV;

calculating a score value ("SV") for the wellbore measurement based on the MQV, the TV, and the RV, wherein the SV is a number between 0 and 2*TV, and the SV indicates a quality of the wellbore measurement independent of the unit of measurement of the wellbore measurement;

providing, for display, at least one of the MQV, the TV, the RV, or the SV; and initiating another acquisition, by the formation tester, another wellbore measurement from the at least one depth in the wellbore when the SV indicates that the quality of the wellbore measurement is below a validity threshold.

17. The method of claim 16, wherein the wellbore measurement is acquired in conjunction with a pressure test that is performed prior to collecting a formation fluid sample.

18. The method of claim 16, wherein the SV is assigned a graphic designation, or the SV is assigned a quality attribute and the quality attribute is assigned a graphic designation.

19. The method of claim 16, further comprising:

assigning a weighting factor ("WF") to the MQV, the WF being a number between 0 and 1, wherein 0 is weighted the lowest and 1 is weighted the highest; and calculating a weighted score value ("WSV") for the wellbore measurement based on a formula comprising:

$$WSV = \sum_{i=1,n}\left(SV_i \frac{WF_i}{\sum_{i=1,n} WF_i}\right),$$

wherein $WF_i$ is an individual WF for the $SV_i$, the SV for an individual MQV, and n is a number of individual MQVs and SVs.

20. The method of claim 19, further comprising providing, for display, the WSV.

21. A system comprising:

at least one processor configured to:

acquire, by a formation tester, a wellbore measurement from at least one depth in a wellbore in a subterranean formation, the wellbore measurement having a unit of measurement;

determine from the wellbore measurement, a measured quality value ("MQV");

assign a threshold value ("TV") and a range value ("RV") to the MQV, the RV being assigned based on geometric scaling of the TV, and the RV defining limits of the MQV above and below the TV;

calculate a score value ("SV") for the wellbore measurement based on the MQV, the TV, and the RV, wherein the SV is a number between 0 and 2*TV, and the SV indicates a quality of the wellbore measurement independent of the unit of measurement of the wellbore measurement;

provide, for display, at least one of the MQV, the TV, the RV, or the SV; and initiate another acquisition, by the formation tester, another wellbore measurement from the at least one depth in the wellbore when the SV indicates that the quality of the wellbore measurement is below a validity threshold.

22. The system of claim 21, wherein the SV is assigned a graphic designation, or the SV is assigned a quality attribute and the quality attribute is assigned the graphic designation.

23. The system of claim 21, wherein the at least one processor is further configured to:

assign a weighting factor ("WF") to the MQV, the WF being a number between 0 and 1, wherein 0 is weighted the lowest and 1 is weighted the highest; and calculate a weighted score value ("WSV") for the wellbore measurement based on a formula comprising:

$$WSV = \sum_{i=1,n}\left(SV_i \frac{WF_i}{\sum_{i=1,n} WF_i}\right),$$

wherein $WF_i$ is an individual WF for the $SV_i$, the SV for an individual MQV, and n is a number of individual MQVs and SVs.

24. The system of claim 23, wherein the at least one processor is further configured to:

provide, for display, the WSV.

25. A system comprising:

a conveyor configured to lower a formation tester to at least one depth in a wellbore in a subterranean formation;

the formation tester configured to:

collect a formation fluid sample from the at least one depth in the wellbore in the subterranean formation;

acquire, independent of the formation fluid sample, a wellbore measurement ("WM") from the at least one depth in the wellbore in the subterranean formation; and transmit the WM to a processor;

the processor configured to:

determine a measured quality value ("MQV") from the WM received from the formation tester;

assign a threshold value ("TV") and a range value ("RV") to the MQV, the RV being assigned based on geometric scaling of the TV, and the RV defining limits of the MQV above and below the TV;

calculate a score value ("SV") for the WM based on the MQV, the TV, and the RV, wherein the SV is a number between 0 and 2*TV, and the SV indicates a quality of the WM;

provide, for display, an indication of the SV calculated for the WM to indicate a quality associated with the collected formation fluid; and initiate another acquisition, by the formation tester, of another WM from the at least one depth in the wellbore when the SV indicates that the quality of the WM is below a validity threshold.

* * * * *